United States Patent [19]

Haines

[11] Patent Number: 4,640,430

[45] Date of Patent: Feb. 3, 1987

[54] SCREW CAPS FOR CONTAINERS

[75] Inventor: Peter R. Haines, Skelmersdale, England

[73] Assignee: M C G Plastics Limited, Lancashire, England

[21] Appl. No.: 809,866

[22] Filed: Dec. 17, 1985

[30] Foreign Application Priority Data

Dec. 18, 1984 [GB] United Kingdom ..... 8431914
Feb. 12, 1985 [GB] United Kingdom ..... 8503523

[51] Int. Cl.[4] ..... B65D 41/04
[52] U.S. Cl. ..... 215/330
[58] Field of Search ..... 215/330, 331, 332

[56] References Cited

U.S. PATENT DOCUMENTS 1,676,023 7/1928 Hammer ..... 215/331
3,182,843 5/1965 Foye ..... 215/331
3,794,200 2/1974 Marks ..... 215/330 X

FOREIGN PATENT DOCUMENTS 1565171 4/1969 France ..... 215/332
986991 3/1965 United Kingdom ..... 215/332

*Primary Examiner*—Donald F. Norton
*Attorney, Agent, or Firm*—Roland T. Bryan

[57] ABSTRACT

A moulded screw-cap for a container has a plurality of screw-thread ridges 24 formed internally of the skirt 19 of the cap each ridge having helical first portion 25 extending away from the top 18 and a second portion 26 of substantially zero helix angle. The circumferential distance A between the nose 28 of portion 26 and the line 29 of the lower face of portion 25 of each ridge 24 is less than the circumferential distance between the thread ridges on the container. A transition portion 27 is provided between portions 25 and 26 and, during application of the cap to a container allows the portions 26 to drop into the gaps between adjacent thread ridges on the container sufficiently to bring the upper surfaces of portion 26 into correct position for engagement with complementary inclined surfaces of the projections on the container, so that no downward pressure need be applied to the cap.

7 Claims, 3 Drawing Figures

SCREW CAPS FOR CONTAINERS

This invention relates to caps for containers and has a particularly useful, but not exclusive, application in certain types of containers, for example for foodstuffs, provided with replaceable screw-caps which have a tendency to loosen by reason for example of vibration and/or variations of temperature.

According to the present invention in one aspect there is provided a cap for a container which cap comprises a top and a depending skirt the internal surface of which is formed with inward projections for screw-threaded engagement with the neck of the container, each of said projections having a surface facing generally towards the top which surface has, in the direction of rotation during application of the cap, a leading portion extending circumferentially with a zero helix angle and a trailing portion inclined towards the top.

According to the invention in another aspect there is provided a cap for a container which cap comprises a top and a depending skirt the internal surface of which is formed with a screw-thread ridge which extends helically in a direction away from the top at a first helix angle and terminates in a portion of lesser helix angle. Preferably said lesser angle is zero or substantially zero.

The invention also provides the combination of a container and cap therefor, the container having a neck defining a mouth the external surface of which is formed with a plurality of outward thread projections each having a surface facing away from said mouth, each of said surfaces having, considered in relation to the direction of rotation in application of the cap, a trailing portion which has a zero helix angle and a leading portion which is inclined towards the mouth, and said cap comprising a top and a depending skirt the internal surface of which is formed with inward projections for screw-threaded engagement with the neck of the container, each of said inward projections having a surface which has, considered in relation to the direction of rotation in application of the cap, a leading portion having a zero helix angle and a trailing portion inclined towards the top.

The invention further provides, in combination, a container having a neck the external surface of which is formed with a plurality of circumferentially spaced ridges providing a multiple start screw-thread, the lower face of the end portion of each ridge further from the top of the neck having a substantially zero helix angle, and a moulded plastics cap detachably secured on the neck of the closure which cap comprises a top and a depending skirt the internal surface of which is formed with ridges providing the respective starts of a multiple start screw-thread corresponding to that of the container, each of said ridges on the cap extending helically in a direction away from the top and terminating in a portion having a zero or substantially zero helix angle, which portions engage said lower faces of said end portions of the ridges on the container, the arrangement being such that when the cap is fully screwed home a sealing surface of the cap comes into engagement with a co-operating surface of the container.

In this context the leading face of a thread ridge or equivalent inward projection on the cap is that face which comes into engagement with a face of a thread ridge or equivalent outward projection on the container when the cap is being applied, and the leading face of such outward projection on the container is that face of the ridge which is engaged by the said leading face of such inward projection on the cap.

One embodiment of the invention will now be described with reference to the accompanying drawings in which.

Figure 3:
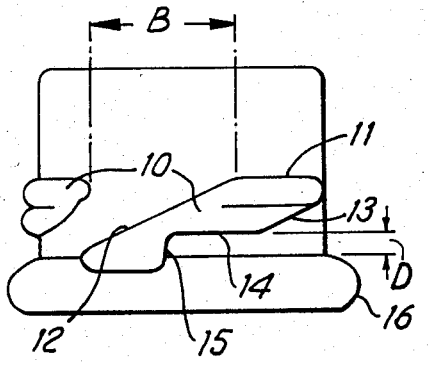
FIG. 3 shows the neck portion of a container for which the cap shown in FIGS. 1 and 2 is intended.

Referring first to FIG. 3, there is shown the neck of a known type of glass container having a three-start thread formation for the attachment of a cap. Each thread start is provided by a projection in the form of a ridge 10 having a horizontal top face 11, a helically inclined upper surface 12, and a lower surface of which a part 13 is helically inclined and a part 14 has a zero helix angle. Surface part 14 terminates at a circumferentially facing surface 15. In reference to the relative rotational movement of the cap and container during application of the cap, the surface part 13 constitutes the leading surface of the the thread ridge and surface 12 constitutes the trailing face of the ridge. Faces 12 and 13 are skewed at the same angle with respect to the central axis of the container and for practical purposes can be deemed to be parallel to each other. Below the ridges is a rib 16, known as the transfer ring, which is used in the well-known manner in manufacture of the glass container.

Figure 1:
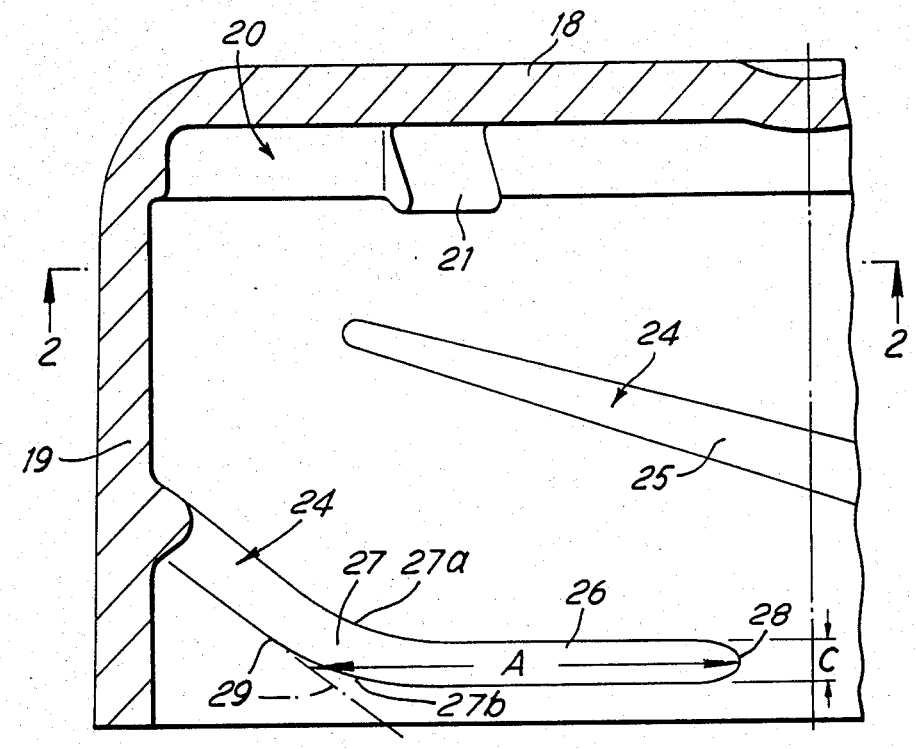
FIG. 1 shows a cap according to the invention in half axial section.
Figure 2:
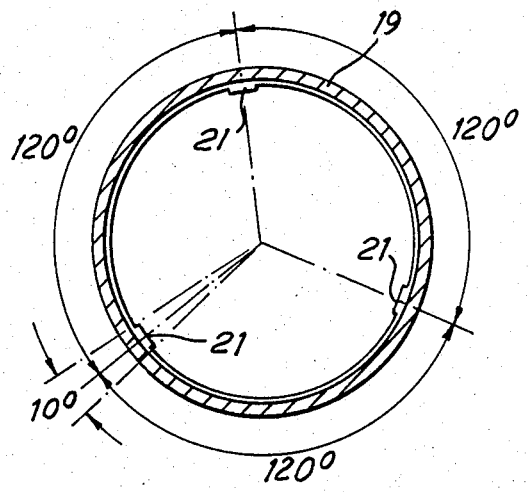
FIG. 2 is a sectional view on the line 2—2 of FIG. 1.

FIG. 1 and 2 show, on a different scale from FIG. 3, a cap moulded from a resilient plastics material and designed for the neck of the container. The cap has a top 18 and a depending skirt 19. Just below the top the skirt has a recess 20 for accommodating a sealing gasket, which is held captive by integrally moulded lugs 21 evenly spaced round the recess.

The internal surface of the skirt is formed with three inward projections in the form of ridges 24 forming a three-start screw-thread. The upper portions 25 of each thread ridge are of helical form but the bottom end portion 26 of each ridge has a zero helix angle. Portion 26 is joined to portion 25 by a smoothly curved transition portion 27. The upper and lower faces of each ridge 24 constitute the leading and trailing faces respectively of the ridge.

According to a preferred feature of this invention the length of the zero helix angle portion 26 is such that the circumferential dimension A between the leading end 28 of the portion 26 of each ridge 24 and the line 29 of the trailing face of the same ridge 24 is slightly greater than the circumferential dimension B between the leading face 13 of each ridge 0 on the container neck and the parallel trailing face 12 of the next succeeding ridge 10. When the cap is screwed on to the container neck its ridges 24 co-operate with those of the container to pull the cap down into sealing engagement with the container. Since the dimension A of the cap is slightly greater than the dimension B of the complementary part of the thread on the neck of the container, the two faces defining dimension A are an interference fit between the faces defining dimension B resulting in slight resilient distortion of the screw-thread ridges and a slight increase of manual effort is in consequence required to turn the cap. The curved trailing (lower) faces 27b of the curved transitional portions 27 permit the cap to drop sufficiently to bring the upper faces of the portions 26 of the thread ridges 24 into correct position for engagement with the leading faces 13 of the ridges 10, so that it is unnecessary to press the cap downward, simple rotation being all that is necessary. When the leading end 28 reaches the lower end of face 13, the portions 26 of its thread ridges engage the surface parts 14 of the ridges on the container, then the curved leading (upper) faces 27*a* of the curved transitional portions 27 contact the corner portions of ridges 10 between the surfaces 13 and 14. Subsequently, the leading faces of the helical portions 25 of the thread ridges on the cap come into contact with the leading faces 13 of the ridges 10 on the container. This contact effectively constitutes a stop on the rotational tightening of the cap. In some cases, however, the leading end 28 may by reason of the manufacturing tolerances come into contact with abutment 15 and thus stop rotational tightening before the helical portions 26 come into engagement with the faces 13. Thus the portions 26 are already in, or come immediately into engagement with the surface part 14 on occurrence of any accidental unscrewing movement of the cap, due say to vibration, and there is then no inherent tendency to loosen because there are no helically inclined surfaces in contact. In some forms of the container the abutment 15 is omitted.

When the cap is to be unscrewed the initial rotation is easy but a slightly increased manual turning effort may be required when the leading ends 28 and trailing faces of the ridge 24 enter between the leading and trailing faces of the ridges 10 on the container neck. In consequence, the arrangement provides the cap with an inherent resistance to rotation which would loosen the seal, even if the cap rotates away from its "closed" end position by reason of vibration, temperature change or other factors. The tendency to loosen is a particular problem with multiple-start threads because of the helix angle which is employed.

Preferably the axial distance between the lower surface of the sealing gasket and the upper surface of the bottom end portion 26 of the rib of the cap is slightly less than the axial distance between the top end of the neck and the bottom face of part 14 of the ridge of the container so that the engagement between the zero helix angle portions of the cap and the container causes the cap to be pulled down so as to form a tight seal between the sealing gasket and the top end of the neck. Whenever the form of the seal between the cap and the container involves axial abutment of respective surfaces on the two members, a similar device can be employed to form a tighter seal.

It will be understood that various alternative ways of holding a sealing gasket captive within the cap are available and also that the cap may alternatively have a flowed-in gasket or may be provided with integrally moulded annular sealing ribs, fins or surfaces to form a seal with the neck of the container.

Caps in accordance with the invention may be used for containers having their contents under internal pressure or internal vacuum or at atmospheric pressure and is equally suitable for containers made from plastics or metal.

The end portion 26 may if desired be axially thickened in a downward direction so that dimension C of the end portions is greater than the complementary dimension D between the upper flank of the transfer ring 16 and the lower flanks of parts 14 of ridges 10, to cause its lower face to come into frictional contact with the upper flank of the transfer ring 16, so as to produce increased friction which further resists accidental loosening of the cap.

The transition portion may, instead of being smoothly curved, have a constant helix angle intermediate that of the upper ridge portion 24 and zero. In one example of the cap having a three-start thread the portion 24 has a helix angle of 12° 41′ extending over an angle of 120° about the central axis of the cap, the transition portion has a helix angle of 5° and extends over 10° about the central axis, and the non-helical portion 26 extends over 46° about the central axis.

The form of the screw-thread ridges in the illustrated construction is further advantageous in stiffening the skirt against forces tending to distort it. When the cap is tightened on the container, the angles of the flanks of the screw-thread may produce a cam action pressing the skirt radially outward at the locations of the ridges and tending to pull the skirt inward at locations between the ridges. By reason of the relatively long length of the ridge portions 25 and 26, the skirt is reinforced against these deforming forces.

What is claimed is:

1. A cap for a container which cap comprises a top and a depending skirt having an internal surface which is formed with inward projections for screw-threaded engagement with the neck of the container, each of said projections having a surface facing generally towards the top which surface has, in the direction of rotation during application of the cap, a leading portion extending circumferentially with a zero helix angle and a trailing portion inclined towards the top.

2. A cap for a container which cap comprises a top and a depending skirt, a screw-thread ridge formed on the internal surface of the skirt which ridge comprises a first portion extending helically in a direction away from the top at a first helix angle and an end portion furthest from the top having a lesser helix angle, said two portions of said surface of the ridge merging in a smooth curve.

3. The combination of a container and cap therefor, the container having a neck defining a mouth the external surface of which neck is formed with a plurality of outward thread projections each having a surface facing away from said mouth, each of said surfaces having, considered in relation to the direction of rotation in application of the cap, a trailing portion which has a zero helix angle and a leading portion which is inclined towards the mouth, and said cap comprising a top and a depending skirt the internal surface of which is formed with inward projections for screw-threaded engagement with said outward projections on the neck of the container, each of said inward projections having a surface which faces generally towards the top and which has, considered in relation to the direction of rotation in application of the cap, a leading portion having a zero helix angle and a trailing portion inclined towards the top.

4. The combination of a container having a neck defining a mouth and a circumferential sealing surface the external surface of which neck is formed with a plurality of circumferentially spaced ridges providing a multiple start screw-thread, each ridge having a lower surface facing generally away from said mouth and having an end portion further from the mouth the lower surface of which has a substantially zero helix angle, and a moulded plastics cap detachably secured on the neck of the containers and providing internally thereof a sealing surface which is complementary to that of the container which cap comprises a top and a depending skirt the internal surface of which is formed with screw-thread ridges providing the respective starts of a multiple start screw-thread corresponding to that of the container, each of said ridges on the cap having a first portion which extends helically in a direction away from the top and a second portion furthest from the top having a substantially zero helix angle, which portions engage said lower surfaces of said ridges on the container, the arrangement being such that when the cap is fully screwed home said sealing surface of the cap comes into engagement with said complementary surface of the container.

5. The combination claimed in claim 4, wherein the container neck has a transfer ring disposed below the thread ridges and having annular upper and lower faces and wherein the axial thickness of the ridges on the cap at said end furthest from the top is slightly greater than the distance between said lower surface of said end portion of each ridge on the container and the upper surface of the transfer ring.

6. The combination claimed in claim 4, wherein the said two portions of the ridge merge in a smooth curve.

7. The combination claimed in claim 6, wherein the circumferential distance A between the leading end (relative to the direction of rotation of application of the cap) of said substantially zero helix angle part of each thread ridge on the cap, and the directional line of the trailing face of the helical portion of the thread ridge is slightly greater than the circumferential distance B between the leading end of each ridge on the neck of the container and the trailing end of the next succeeding ridge on the neck of the container measured at a location nearest the mouth of the container.

* * * * *